US005464033A

United States Patent [19]

Hartnell

[11] Patent Number: 5,464,033

[45] Date of Patent: Nov. 7, 1995

[54] HOT SOLVENT CLEANING TANK

[75] Inventor: Dale Hartnell, Centralia, Ill.

[73] Assignee: Major Industrial Technology, Inc., Centralia, Ill.

[21] Appl. No.: 245,597

[22] Filed: May 20, 1994

[51] Int. Cl.[6] ..... B08B 3/02

[52] U.S. Cl. ..... 134/105; 134/111; 134/200

[58] Field of Search ..... 134/105, 108, 134/111, 135, 160, 164, 195, 200; 210/167, 169

[56] References Cited

U.S. PATENT DOCUMENTS

| | | | |
|---|---|---|---|
| 1,036,669 | 8/1912 | McClure | 134/195 X |
| 1,771,698 | 7/1930 | Wolff | 134/160 X |
| 2,113,806 | 4/1938 | Hubbard | 134/105 X |
| 2,442,272 | 5/1948 | Jaffa | 134/108 |
| 2,567,416 | 9/1951 | Watson | 134/164 |
| 2,592,857 | 4/1952 | Chadwick | 134/108 X |
| 2,643,662 | 6/1953 | Bunce | 134/164 |
| 2,746,467 | 5/1956 | Dempsey et al. | 134/111 |
| 3,041,212 | 6/1962 | Booth | 134/111 X |
| 3,630,369 | 12/1971 | Nichols | 210/167 X |
| 4,271,099 | 6/1981 | Kukla | 210/169 X |
| 4,773,436 | 9/1988 | Cantrell et al. | 134/111 X |
| 5,056,948 | 10/1991 | Puder et al. | 134/111 X |
| 5,232,299 | 8/1993 | Hiss | 134/200 X |

FOREIGN PATENT DOCUMENTS

| | | | |
|---|---|---|---|
| 3026297 | 2/1982 | Germany | 134/105 |
| 109622 | 1/1944 | Sweden | 134/105 |

*Primary Examiner*—Philip R. Coe
*Attorney, Agent, or Firm*—Robbins & Robbins

[57] ABSTRACT

A hot solvent tank for cleaning various objects such as metallic parts is provided. The solvent is a bio-degradable detergent aqueous solution which is environmentally acceptable. The solvent tank is an open top steel barrel mounted on casters for easy moving and employs a thermostatically controlled heating element. A bottom drain valve is connected at the bottom. The various parts to be cleaned may be immersed in the solvent and supported by chains or baskets hooked over the rim at the top of the barrel. The drain valve may be connected to an accessory cleaning unit comprising a pump and replaceable automotive filter for pumping solvent through a hose and flow through a brush for cleaning parts supported above the solvent at the top of the tank. The filter, which can be discarded when dirty, is effective for removing heavy metal contaminants and providing a purified recirculating solvent. When the pump and filter are employed, the solvent is kept clean and the filter, when dirty, is replaced and recycled for scrap metal. The problem of waste disposal of sludge is eliminated.

6 Claims, 2 Drawing Sheets

HOT SOLVENT CLEANING TANK

BACKGROUND OF THE INVENTION

In the past solvent cleaners have long been employed using petroleum based solvents. While such solvent cleaners have been efficient, the disposal of the petroleum based solvent has been increasingly difficult with attendant inconvenience and added expense since the solvent has been classified as a hazardous waste material.

To avoid the use of petroleum based solvents, biodegradable detergents in an aqueous solution have been employed. In order to be effective, stationary tanks have been utilized with heating elements to clean industrial and automotive parts and the like. The aqueous solvent, when disposal is needed, does not require the rigorous hazardous waste standards of petroleum based solvents.

While such biodegradable solvent cleaning systems have been efficient, their use of heating equipment has necessitated cumbersome heavy installations that are not readily transportable and make accessibility of individual parts to be cleaned difficult. Other solvent cleaners have also employed screens or cartridge type filters which are messy to clean and dispose of.

SUMMARY OF THE INVENTION

By means of this invention, there has been provided a transportable tank and heater for a biodegradable aqueous detergent for solvent cleaning of parts of one type or another.

The invention in its simplest form employs an open top tank, such as a steel drum, fitted with castors enabling the movement of the drum from one area of use to another. The drum is filled with an aqueous biodegradable solvent and parts to be cleaned may be suspended by chains or baskets attached to the rim of the tank. A drain valve at the bottom of the tank provides for draining the tank when necessary.

Heating of the aqueous solvent is provided by an internal heating element controlled by a thermostat on the tank. The heat of the solvent is thereby controlled for the most efficient cleaning action of the solvent.

Also, used with the tank is an exterior flow through solvent sludge and rinsing brush. A hose is connected to the drain valve and by means of a pump and filter, solvent and sludge from the bottom of tank is pumped through the flow through brush which is used to brush and clean parts that are supported at the top of the tank above the level of the solvent within the tank. In this manner, parts which may have been previously immersed within the solvent may be given a brushing and cleaning treatment with the solvent being recirculated in the tank. The filter of this invention utilizes a "spin on" filter trap sludge pulled by the pump from the bottom of the tank. The filter is removed without mess and is recycled with other automotive type filters eliminating an environmental disposal problem of the sludge from the solvent tank. The solvent is thereby recirculated through the filter and disposal of dirty solution is not necessary due to the cleaning of the recirculated solvent. The tank system is thereby rendered pollution free, requiring only occasional replacement of the filter by fresh filter units and simple recycling disposal of the dirty filter.

The portable hot solvent cleaning tank can be employed for various types of cleaning and due to its comparatively small size, can readily be moved to different locations as needed. It is rugged and simple in construction and operation and due to the biodegradable nature of the aqueous detergent solution employed, does not provide a hazardous waste disposal problem as in the case of petroleum based solvents.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
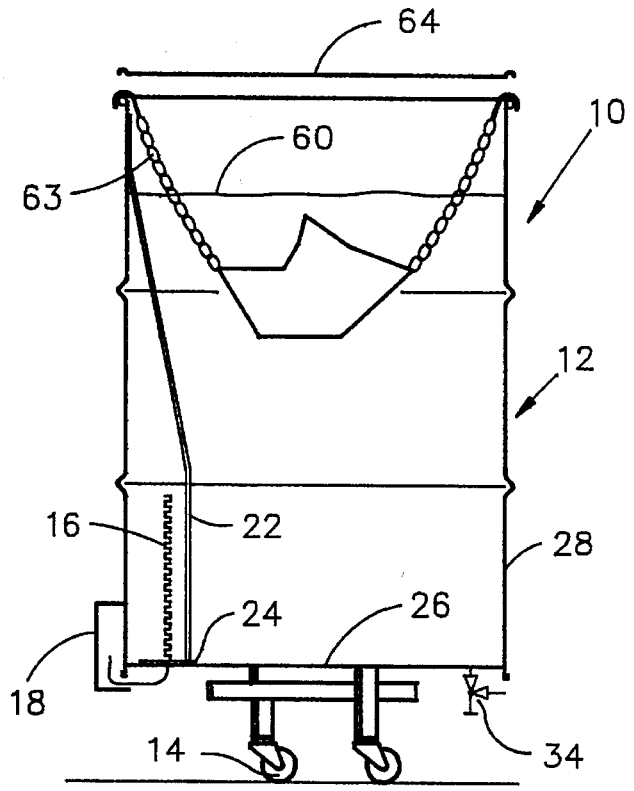
FIG. 1 is a view in side elevation of the tank broken away to show the internal parts.
Figure 3:
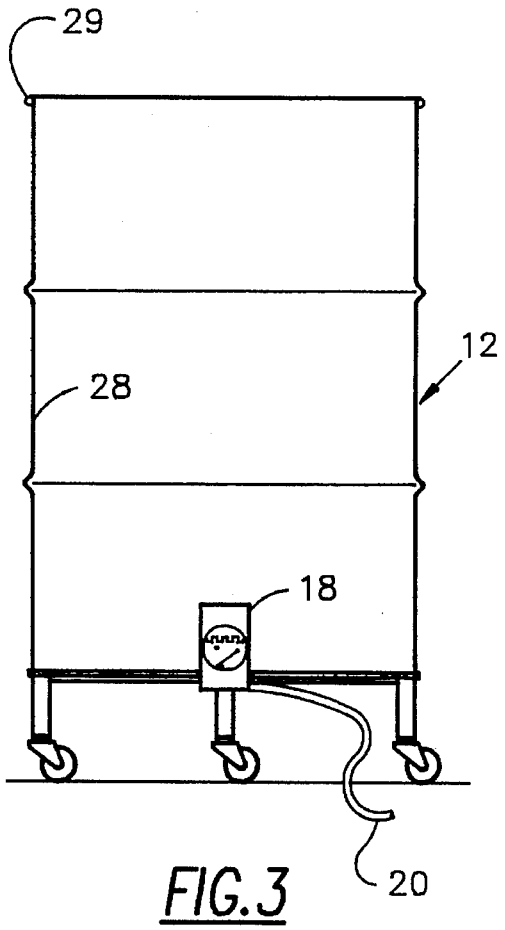
FIG. 3 is a view in side elevation of the tank taken from the left side of FIG. 1.
Figure 2:
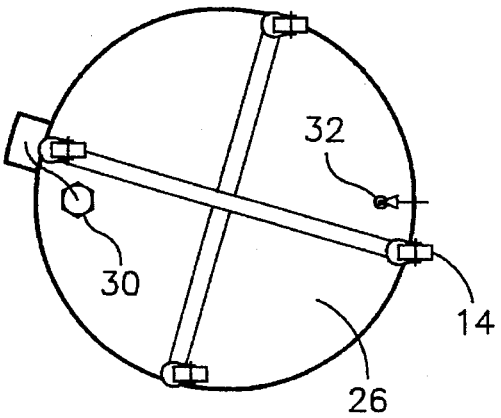
FIG. 2 is a bottom plan view of the tank.

The hot solvent cleaning tank of this invention is generally indicated by the reference numeral 10 in FIGS. 1–4. It is comprised of an open top tank 12 supported at the bottom upon castors 14 in order that it may be easily moved about on the floor of a building.

In order to heat the solvent, an upstanding electrical heating element 16 is supported on the bottom of the tank. A thermostat 18 mounted on the exterior of the tank provides for simple control of the heating element and the temperature of the solvent for different applications as desired. A cord 20 is used to plug into any available electrical outlet. The electrical system is designed for either 220 V or 110 V. For protection of the heating element from damage by contact with parts immersed in the solvent in the tank, a protective guard bar 22 is employed. The guard bar may be welded to a washer 24 positioned over the heating element at the bottom of the tank and fixed to the top portion of the tank by a bolt or the like.

The tank employed may be a 55 gallon or 30 gallon steel drum or barrel although it will be understood that other materials may also be employed. The bottom 26 is designed to be leak proof and may employ a chemically resistant seal, not shown, at the junction of the bottom 26 and sides 28 of the tank. A rolled rim 29 is provided at the top for easy grasping and connecting of chains for supporting the objects to be cleaned or support baskets. The tank is also provided with a conventional threaded bung hole 30 which receives the heating element for convenient installation. Likewise, a smaller conventional bung hole 32 receives a drain valve 34 for draining the liquid solvent as desired or for connection to a solvent flow through brush or other flow directing and application means such as a sprayer, as will be more fully described below.

Figure 4:
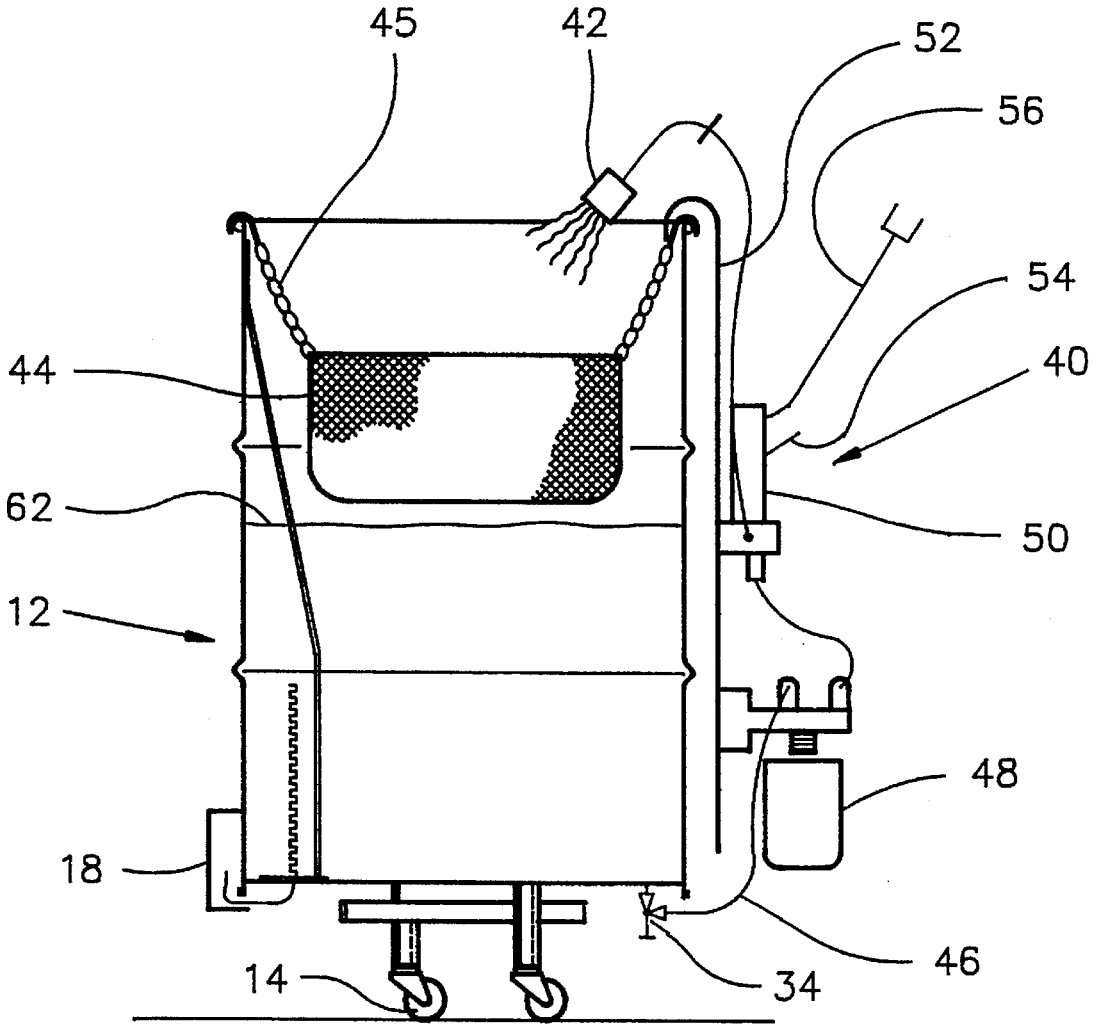
FIG. 4 is a view similar to FIG. 1 showing accessory equipment.

In FIG. 4, a flow through brush cleaning device generally indicated by the reference numeral 40 is disclosed. It draws hot solvent from the tank 12, passes it through a flow through brush 42 for cleaning parts in a basket 44 suspended by a chain 45 hooked on the barrel rim above the solvent level in the tank and is recirculated.

The flow through cleaning brush system is connected to the tank 12 by a hose 46 screwed on the drain valve 34. A CAT type filter 48 is employed to filter sludge and waste particles in advance of a pump 50. Both the filter and pump are supported on a rigid support hook 52 adapted to fit over the rim of the tank. The pump is operated by a switch 54 and is connected to an electrical supply source by cord 56. The flow through brush serves to brush and dislodge adhering various waste particles and with the flushing action of the solvent flowing through the brush efficiently cleans and removes waste particles from the parts to be cleaned in the basked 44 while returning solvent to the tank.

Conventional hot tanks use a sludge sump or tray in the bottom that requires draining solution to remove sludge for disposal. Sometimes the user may clean parts that release hazardous metal known by the Environmental Protective Agency (EPA) as Heavy Metals. These can often be encountered in cleaning automotive parts and can include one or more of arsenic, barium, cadmium, chromium, copper, lead, mercury, molybdenum, nickel selenium, silver and zinc. The concentration of heavy metal is measured in parts per million (PPM) and must be tested by an EPA approved laboratory using the Total Concentration Leaching Procedure (TCLP), which is the ability for metals to flow into ground water we may drink. If the TCLP test totals are above Federal and State regulatory levels then the sludge must be hauled off by a licensed hazardous waste hauler. The flow through brush cleaning device employs the pump to remove sludge from the bottom of the unit and the filter to trap any heavy metals. The filter is recyclable unlike other cleaners. When the easy, spin on type filter with heavy metal concentration and sludge is disposed of, it will be disposed of with ordinary automotive type oil filters that are taken to a scrap metal processor for recycling. By changing the spin on sludge filter periodically, the aqueous solution is kept clean and requires no disposal to remove sludge. The solution recycled is clean at all times.

The tank system is used as both an immersion cleaner and a recirculation parts cleaner with biodegradable detergent approved by the EPA. The pump and filter recirculating system makes the unit a pollution free parts cleaner and eliminates the requirement any licensed hazardous waste disposal.

USE

The hot solvent cleaning tank of this invention is very simply employed by filling to the level desired for immersion of the parts to be cleaned such as the level 60 indicated in FIG. 1, or 62 as indicated in FIG. 4, depending on the type of cleaning involved. The solvent employed may be any conventional detergent, such as a buffered alkaline detergent.

After filling to the desired level, the heating element is turned on and the thermostat is adjusted to a temperature such as 140° to 180° F. The solvent will come up to temperature in a short period of time from one to three hours or so, depending on the liquid level, the size of the tank and whether a 220 V or 110 V system is employed. After coming up to temperature, the thermostat maintains the desired degree of heat.

The structure of the tank employing for example, an open type barrel, lends to safe and easy handling. The rolled top rim being of about an elevation at the waist of the user provides for safe grasping and moving the tank from one area to another and receiving securing hooks on chains employed to support the parts basket 44 or heavy items such as engine blocks or the like. A conventional open top barrel lid 64 provides for closing the top of the tank to maintain and prevent loss of heat, prevent sloshing when moving the tank and preventing accidental dropping and entry of unwanted foreign objects when in use.

The parts to be cleaned can be various types of industrial and automotive part of metal or plastic to remove oil, grease, dirt and paint without scraping, scrubbing and wire brushing. The parts may be placed on the bottom 22 of the tank, suspended by chains from the rim or placed in wire baskets as desired. After the parts have been cleaned, they are removed and rinsed by a hose or water spray.

When the unit is desired to be drained, the drain valve is employed to empty the contents in an appropriate manner through a hose or the like. Since an aqueous detergent solution is employed, the rigorous hazardous waste disposal requirements of petroleum based solvents are not present. The aqueous detergent waste solvent can be simply disposed, observing local codes.

The flow through brush cleaning device 40 shown in FIG. 4 may be employed with other parts immersed below the level 62. By connecting the hose 46 to the drain valve 34 and hooking the unit over the rim of the tank, the device may be used as desired by operating the switch 54 of the pump 50 to cause the hot solvent to circulate through the device. The "spin on" filter is simply unscrewed when dirty and replaced by a fresh filter. The circulation and cleaning of the solvent provides for maintenance of the cleanliness of the solvent while facilitating simple disposal of dirty filters. Buildups of contaminants such a lead and mercury in the sludge is thereby inhibited. The filter is of conventional construction commonly employed in the radiator cooling system of diesel engines such as those employed in over the road semi trailer trucks or the like, to control alkalinity and metal contaminants under the trade names Wix, Purolator and Baldwin.

Parts placed in the basket 44 above the level 62 of the solvent can be brushed and rinsed in either a primary or final cleaning stage. The solvent and particles, such as dirt, grime, rust and paint particles, return to the tank while cleaning may continue for other parts immersed below the level of the solvent either in wire baskets, or suspended by chains as in FIG. 1, or placed on the bottom of the tank.

Various changes and modifications may be made within this invention as will be apparent to those skilled in the art. Such changes and modifications are within the scope and teaching of this invention as defined in the claims appended hereto.

What is claimed is:

1. A hot solvent cleaning tank for cleaning objects, said tank being comprised of an upright barrel mounted on supporting castors for mobility, means for heating a biodegradable aqueous solvent in said tank comprising an electrical heating element supported within said tank for heating said solvent, a thermostat control means mounted on an exterior portion of the tank for maintaining a controlled temperature of the solvent, a drain valve, and solvent recirculating means for recirculating solvent through said drain valve to a flow directing means for directing a stream of solvent against objects supported at the top of the tank above a level of the solvent within the tank, said flow directing means comprising a pump, and a member connecting the pump to a flow through brush, a replaceable filter being connected between the pump and said drain valve.

2. The hot solvent cleaning tank of claim 1 in which said filter and pump are connected to a support hook adapted to be hooked over the rim of the barrel.

3. The hot solvent cleaning tank of claim 2 in which the barrel has a large threaded bung hole in the bottom receiving said heating element and a smaller threaded hole receiving a drain valve.

4. A hot solvent cleaning tank for cleaning objects, said tank being comprised of an upright barrel mounted on supporting castors for mobility, means for heating a biodegradable aqueous solvent in said tank, an electrical heating element supported within said tank for heating said solvent and a thermostat control means mounted on an exterior portion of the tank for maintaining a controlled temperature of the solvent, said tank having a bottom drain provided with a drain valve and means receiving a hose, said heating element extending upwardly from the bottom of the tank adjacent a side of the barrel, a protective member for the heating element connected to the bottom and extending upwardly and over the heating element to an interior side of the barrel to protect the heating element from contact by objects within the barrel, the barrel having a large threaded bung hole in the bottom receiving said heating element, a smaller threaded bung hole receiving the drain valve, a rolled top rim receiving a cover lid for the barrel.

5. The hot solvent cleaning tank of claim 3 in which the objects to be cleaned are supported by hooked chains fitting over the rim of the barrel, said hooked chains supporting selectively baskets supporting the objects and the objects alone.

6. A hot solvent cleaning tank for cleaning objects, said tank being comprised of an upright barrel mounted on supporting castors for mobility, means for heating a biodegradable aqueous solvent in said tank comprising an electrical heating element supported within said tank for heating said solvent, a thermostat control means mounted on an exterior portion of the tank for maintaining a controlled temperature of the solvent, a drain valve, and solvent recirculating means for recirculating solvent through said drain valve to a flow directing means for directing a stream of solvent against objects supported at the top of the tank above a level of the solvent within the tank, said flow directing means comprising a pump and a member connecting the pump to a flow through brush, said flow directing means being provided with hook means for hooking over the rim of the barrel.

* * * * *

UNITED STATES PATENT AND TRADEMARK OFFICE

CERTIFICATE OF CORRECTION

PATENT NO. : 5,464,033

DATED : November 7, 1995

INVENTOR(S) : Dale Hartnell

It is certified that error appears in the above-identified patent and that said Letters Patent is hereby corrected as shown below:

Col. 5: Claim 4, line 18, after "barrel", there should be added -- the objects to be cleaned being immersed in the solvent supported by hooked chains fitting over the rim of the barrel, said hooked chains supporting selectively baskets supporting the objects and the object alone --.

Signed and Sealed this

Sixteenth Day of January, 1996

Bruce Lehman

BRUCE LEHMAN

*Commissioner of Patents and Trademarks*

*Attest:*

*Attesting Officer*